US011885554B2

(12) United States Patent
Joo et al.

(10) Patent No.: US 11,885,554 B2
(45) Date of Patent: Jan. 30, 2024

(54) REFRIGERATOR AND HOME APPLIANCE

(71) Applicant: SAMSUNG ELECTRONICS CO., LTD., Suwon-si (KR)

(72) Inventors: Yongwoo Joo, Suwon-si (KR); Hosang Park, Suwon-si (KR); Taekyun Kim, Suwon-si (KR); Wansu Park, Suwon-si (KR); Yountae Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/826,795

(22) Filed: May 27, 2022

(65) Prior Publication Data

US 2023/0073682 A1 Mar. 9, 2023

Related U.S. Application Data

(63) Continuation of application No. PCT/KR2022/007107, filed on May 18, 2022.

(30) Foreign Application Priority Data

Sep. 3, 2021 (KR) ..... 10-2021-0117327

(51) Int. Cl.
*F25D 19/04* (2006.01)
*F25D 23/06* (2006.01)

(52) U.S. Cl.
CPC ..... *F25D 19/04* (2013.01); *F25D 23/065* (2013.01)

(58) Field of Classification Search
CPC ..... F25D 19/04; F25D 23/065; F25D 23/062; F25D 2323/06; F25D 2400/14
See application file for complete search history.

(56) References Cited

U.S. PATENT DOCUMENTS 5,921,095 A * 7/1999 Lee ..... F25D 29/005 62/DIG. 13
7,004,436 B2 * 2/2006 Knapp ..... F16B 5/0032 248/221.11

(Continued)

FOREIGN PATENT DOCUMENTS

CN 103174709 6/2013
CN 103486114 1/2014

(Continued)

OTHER PUBLICATIONS

English translation of CN 103486114A from espacenet (Year: 2023).*

(Continued)

*Primary Examiner* — Daniel J Rohrhoff
(74) *Attorney, Agent, or Firm* — STAAS & HALSEY LLP

(57) ABSTRACT

A refrigerator includes a first refrigerator including a first cabinet and a second refrigerator including a second cabinet, and operating independently from the first refrigerator. A first connector is installed on the first cabinet; and a second connector is installed on the second cabinet to correspond to the first connector. The second connector is configured to be coupled to the first connector, such that in a state in which the first connector and the second connector are coupled to each other, a movement of the first cabinet in a first direction with respect to the second cabinet is allowed, and a movement of the first cabinet in a second direction with respect to the second cabinet is restricted, with the second direction being perpendicular to the first direction.

16 Claims, 12 Drawing Sheets

(56) References Cited

U.S. PATENT DOCUMENTS

| | | | | |
|---|---|---|---|---|
| 2009/0077996 | A1* | 3/2009 | Gorz | F25D 23/062 62/441 |
| 2009/0151385 | A1* | 6/2009 | Hagele | F25D 23/062 62/298 |
| 2009/0266102 | A1* | 10/2009 | Gorz | F25D 23/085 62/441 |
| 2017/0328626 | A1* | 11/2017 | Ng | F25D 23/062 |
| 2021/0247127 | A1* | 8/2021 | Park | F25D 23/066 |

FOREIGN PATENT DOCUMENTS

| | | | | |
|---|---|---|---|---|
| CN | 103486114 | A | * | 1/2014 |
| JP | 51-47060 | U | | 4/1976 |
| JP | 5-164458 | | | 6/1993 |
| JP | 2005-42937 | | | 2/2005 |
| KR | 20-1985-0002181 | | | 10/1985 |
| KR | 10-0202605 | | | 6/1999 |
| KR | 10-2020-0124550 | | | 11/2020 |

OTHER PUBLICATIONS

International Search Report dated Sep. 2, 2022 for International Application No. PCT/KR2022/007107.
Written Opinion of the International Searching Authority dated Sep. 2, 2022 for International Application No. PCT/KR2022/007107.

* cited by examiner

REFRIGERATOR AND HOME APPLIANCE

CROSS-REFERENCE TO RELATED APPLICATION

This application is a continuation application, under 35 U.S.C. § 111(a), of International Application No. PCT/KR2022/007107, filed on May 18, 2022, which is based on and claims priority under 35 U.S.C. § 119 to Korean Patent Application No. 10-2021-0117327, filed on Sep. 3, 2021 in the Korean Intellectual Property Office, the disclosures of which are incorporated by reference herein in their entirety.

BACKGROUND

1. Field

The disclosure relates to a refrigerator and a home appliance, and more particularly, to a refrigerator and a home appliance including a bracket for maintaining a gap between a pair of refrigerators arranged side by side and between a pair of home appliances arranged side by side.

2. Description of the Related Art

A refrigerator is an appliance including a main body having a storage room, and a cool air supplier for supplying cool air to the storage room to keep foods fresh. The storage room includes a refrigerating room that is maintained at about 0° C. to 5° C. to keep foods refrigerated, and a freezing room that is maintained at about 0° C. to 30° C. below zero to keep foods frozen. In general, the storage room opens at the front side to take/put food out/in, and the open front side of the storage room is opened or closed by a door.

Refrigerators are classified according to the types of the storage rooms and doors, and there are a Top Mounted Freezer (TMF) type refrigerator in which a storage room is partitioned into upper and lower spaces by a horizontal partition wall to form a freezing room in the upper space and a refrigerating room in the lower space, and a Bottom Mounted Freezer (BMF) type refrigerator in which a refrigerating room is formed in the upper space and a freezing room is formed in the lower space. Also, there are a Side By Side (SBS) type refrigerator in which a storage room is partitioned into left and right spaces by a vertical partition wall to form a freezing room in one side and a refrigerating room in the other side, and a French Door Refrigerator (FDR) type refrigerator in which a storage room is partitioned into upper and lower spaces by a horizontal partition wall to form a refrigerating room in the upper space and a freezing room in the lower space, wherein the refrigerating room is opened or closed by a pair of doors.

Recently, various home appliances including refrigerators are provided with outer appearances having a sense of unity. In this case, by arranging a plurality of home appliances side by side, instead of spacing the home appliances apart from each other, a sense of unity and an esthetic sense may be improved.

However, in the case in which a gap between the plurality of home appliances arranged side by side changes often, the effect of improvement of the sense of unity and esthetic sense may deteriorate. To prevent the effect from deteriorating, it is necessary to couple the plurality of home appliances arranged side by side with each other.

SUMMARY

In accordance with an aspect of the disclosure, a refrigerator comprises a first refrigerator including a first cabinet, a second refrigerator including a second cabinet, and configured to operate independently from the first refrigerator, a first connector coupled to the first cabinet, and a second connector coupled to the second cabinet and configured to be coupled to the first connector, a movement of the first cabinet in a first direction and a second direction with respect to the second cabinet and a movement of the second cabinet, in the first direction and the second direction with respect to the first cabinet, being allowed based on the first and second connectors being coupled to each other, the second direction being opposite to the first direction, and a movement of the first cabinet in a third direction with respect to the second cabinet and a movement of the second cabinet in the third direction with respect to the first cabinet, being restricted based on the first and second connectors being coupled to each other, the third direction being perpendicular to the first direction and the second direction.

According to an aspect, with reference to the first and second refrigerators, the first direction is a forward direction, the second direction is a backward direction, and the third direction is a left direction or a right direction.

According to another aspect, the first connector is coupled to the second connector to maintain a gap between the first cabinet and the second cabinet in a left-right direction.

According to another aspect, the first connector is coupled to an upper surface of the first cabinet, and the second connector is coupled to an upper surface of the second cabinet.

According to another aspect, the first connector is coupled to one side of a rear end of the first cabinet, and the second connector is coupled to the other side of a rear end of the second cabinet to correspond to the first connector.

According to another aspect, in a state in which the first connector is coupled to the second connector, the first connector is separated from the second connector by moving the first cabinet in the first direction or the second direction with respect to the second cabinet, and the second connector is separated from the first connector by moving the second cabinet in the first direction or the second direction with respect to the first cabinet.

According to another aspect, in a separated state of the first connector and the second connector, the first connector is coupled to the second connector by moving the first cabinet in the first direction or the second direction with respect to the second cabinet, and the second connector is coupled to the first connector by moving the second cabinet in the first direction or the second direction with respect to the first cabinet.

According to another aspect, the first connector comprises a first bracket including a first guide rib and a second guide rib guiding a coupling position of the first bracket with respect to the first cabinet, the first guide rib limits a movement range of the first bracket in the first direction with respect to the first cabinet by contacting a rear surface of the first cabinet, and the second guide rib limits a movement range of the first bracket in the third direction with respect to the first cabinet by contacting a side surface of the first cabinet.

According to another aspect, the second connector comprises a second bracket including a third guide rib and a fourth guide rib guiding a coupling position of the second bracket with respect to the second cabinet, the third guide rib limits a movement range of the second bracket in the first direction with respect to the second cabinet by contacting a rear surface of the second cabinet, and the fourth guide rib limits a movement range of the second bracket in a fourth direction with respect to the second cabinet by contacting a side surface of the second cabinet, the side surface of the second side cabinet facing the side surface of the first cabinet, the fourth direction being opposite to the third direction.

According to another aspect, the first connector comprises a first bracket including a first interfering protrusion, and the second connector comprises a second bracket including a second interfering protrusion restricting a movement of the second bracket in the third direction by being caught by the first interfering protrusion, based on movement of the second bracket in the third direction with respect to the first bracket.

According to another aspect, the first interfering protrusion and the second interfering protrusion do not interfere with each other based on movement of the first bracket or the second bracket in the first direction or the second direction with respect to the second bracket or the first bracket.

According to another aspect, the first bracket includes a first groove in which the second interfering protrusion is inserted, the second bracket includes a second groove in which the first interfering protrusion is inserted, and the first interfering protrusion is inserted into the second groove, and the second interfering protrusion is inserted into the first groove.

According to another aspect, based on the first interfering protrusion being inserted in the second groove, movement of the first bracket in the third direction with respect to the second bracket, is restricted, and based on the first bracket being moved in the first direction or the second direction with respect to the second bracket and the first interfering protrusion being taken out of the second groove, movement of the first bracket in the third direction with respect to the second bracket, is allowed.

According to another aspect, based on the second interfering protrusion being inserted in the first groove, movement of the second bracket in the third direction with respect to the first bracket, is restricted, and based on the second bracket being moved in the first direction or the second direction with respect to the first bracket to take the second interfering protrusion out of the first groove, movement of the second bracket in the third direction with respect to the first bracket, is allowed.

According to another aspect, in a state in which the first interfering protrusion and the second interfering protrusion interfere, the first interfering protrusion and the second interfering protrusion are positioned between a side surface of the first cabinet and a side surface of the second cabinet that face each other.

According to another aspect, an appliance comprises a first appliance including a first cabinet, a second appliance including a second cabinet, a first connector extending from the first cabinet, and a second connector extending from the second cabinet and configured to be coupled to the first connector, the first and second connectors being configured to allow movement of the first and second cabinets in a first direction and a second direction based on the first and second connectors being coupled to each other, the second direction being opposite to the first direction, and the first and second connectors being configured to restrict movement of the first and second cabinets in a third direction and a fourth direction based on the first and second connectors being coupled to each other, the third direction and the fourth direction being opposite to each other, and the third direction being perpendicular to the first direction and the second direction.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
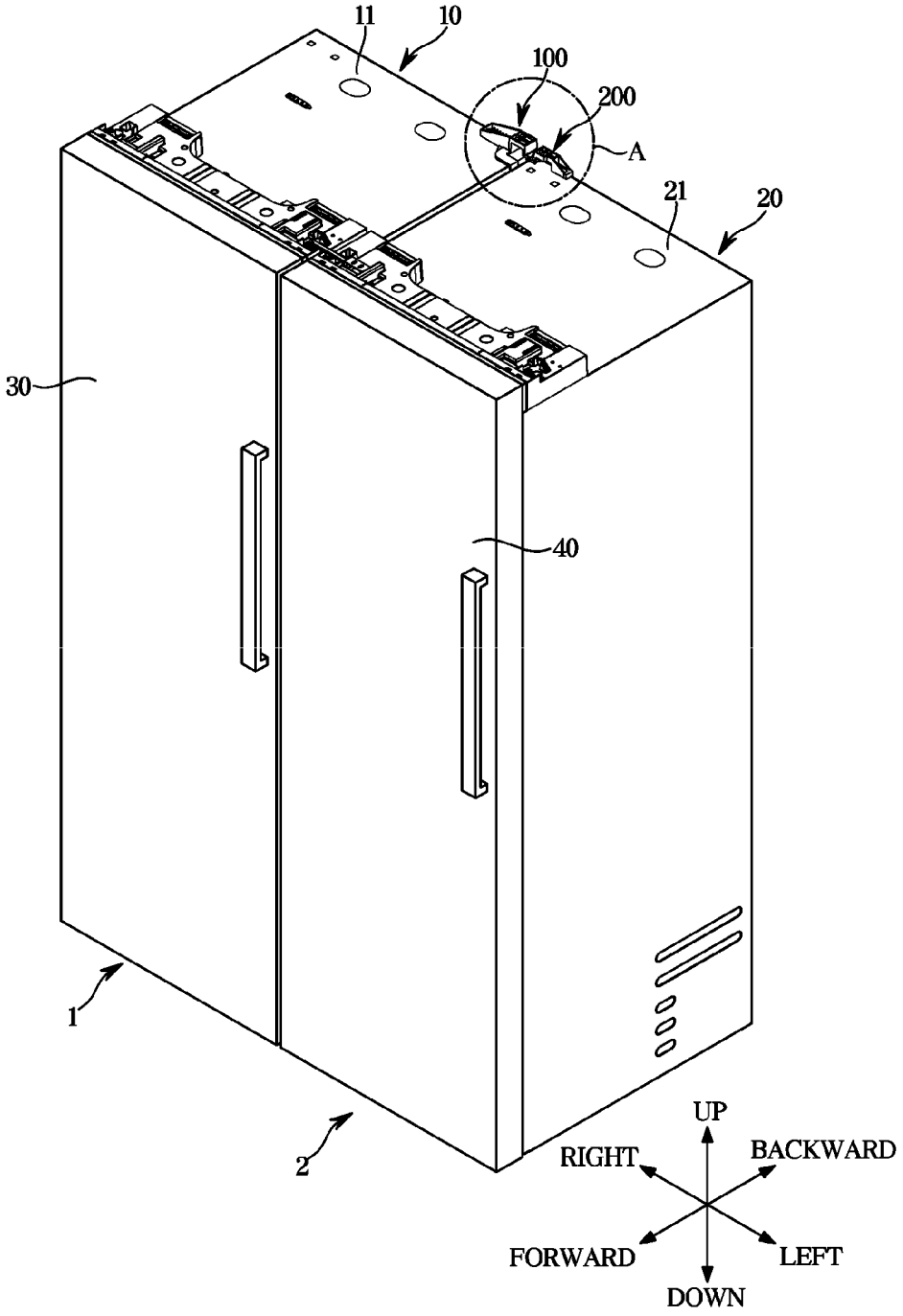
FIG. 1 shows a pair of home appliances arranged side by side, according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the disclosure, not for the purpose of limiting and/or restricting the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Meanwhile, in the following description, the terms "front", "rear", "left", and "right" are defined based on the drawings, and the shapes and positions of the components are not limited by the terms.

Hereinafter, embodiments of the disclosure will be described in detail with reference to the accompanying drawings. In the present specification, up, down, left, right, front, and rear directions are based on directions shown in the drawings.

FIG. 1 shows a pair of home appliances arranged side by side, according to an embodiment of the disclosure.

According to an embodiment of the disclosure, a pair of home appliances may be refrigerators 1 and 2 having the same structure and including a single door 30 and a single door 40, respectively. However, the pair of home appliances may include any type of appliances, such as a refrigerator and a clothes care apparatus. The pair of home appliances may include a first refrigerator and a second refrigerator having different structures. Also, the pair of home appliances may include other home appliances that are different from a refrigerator and a clothes care apparatus. That is, the kind of the home appliances is not limited.

Hereinafter, as an example of the pair of home appliances, the pair of refrigerators 1 and 2 will be described. The pair of refrigerators 1 and 2 may include a first refrigerator 1 and a second refrigerator 2. The first refrigerator 1 and the second refrigerator 2 may operate independently. The first refrigerator 1 may include a first cabinet 10, and a first door 30 rotatably coupled to the first cabinet 10, and the second refrigerator 2 may include a second cabinet 20, and a second door 40 rotatably coupled to the second cabinet 20.

Referring to FIG. 1, the first refrigerator 1 and the second refrigerator 2 may be arranged side by side. In a case in which the first refrigerator 1 and the second refrigerator 2 are arranged simply side by side, a gap g (see FIG. 2) between the first refrigerator 1 and the second refrigerator 2 may change. The reason may be because the first refrigerator 1 and the second refrigerator 2 are structurally not restricted. Because the first refrigerator 1 is structurally not coupled to the second refrigerator 2, a gap between the first refrigerator 1 and the second refrigerator 2 may change, which deteriorates a sense of unity of the pair of refrigerators 1 and 2 and lowers an esthetic sense and a user's satisfaction.

According to an aspect of the disclosure, the first refrigerator 1 may include a first bracket 100 (also referred to as a first connector 100 or a first coupler 100), and the second refrigerator 2 may include a second bracket 200 (also referred to as a second connector 200 or a second coupler 200). By coupling the first bracket 100 to the second bracket 200, the first refrigerator 1 may be structurally paired with the second refrigerator 2. More specifically, the gap g between the first refrigerator 1 and the second refrigerator 2 may be maintained. In a case in which the first refrigerator 1 is structurally paired with the second refrigerator 2 and thereby the gap g between the first refrigerator 1 and the second refrigerator 2 is maintained, the pair of refrigerators 1 and 2 may provide a sense of unity in outer appearance, and furthermore improve an esthetic sense. Also, a user's satisfaction may be improved.

According to an aspect of the disclosure, the first bracket 100 may be separated from the second bracket 200 without releasing a separate coupling member. By separating the first bracket 100 from the second bracket 200, pairing of the first refrigerator 1 and the second refrigerator 2 may be released. That is, the first refrigerator 1 and the second refrigerator 2 may move without interference. Because the first bracket 100 is separated from the second bracket 200 without releasing a separate coupling member, the first refrigerator 1 may be moved out alone in a forward direction to be repaired, or the second refrigerator 2 may be moved out alone in the forward direction to be repaired. Therefore, time and manpower required for product repair may be greatly reduced.

Figure 2:
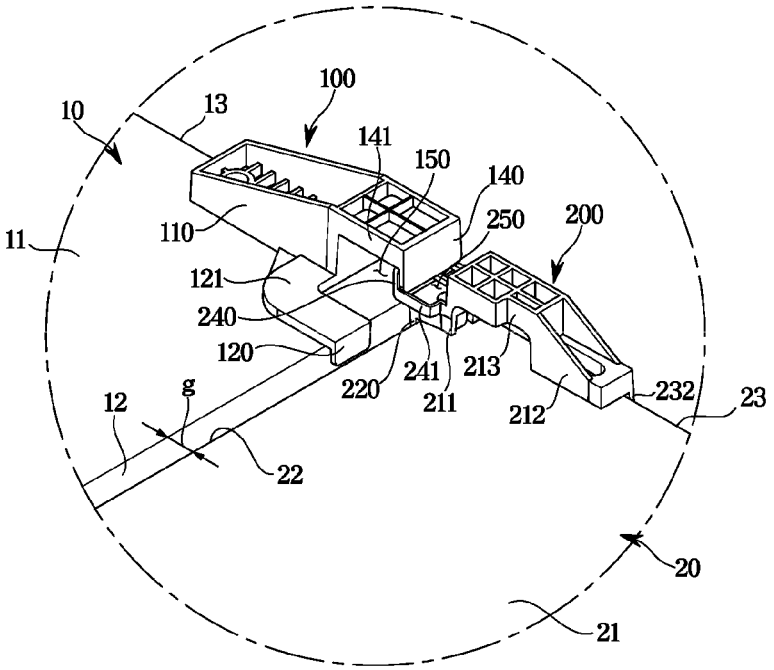
FIG. 2 is an enlarged view showing an area A of FIG. 1.
Figure 3:
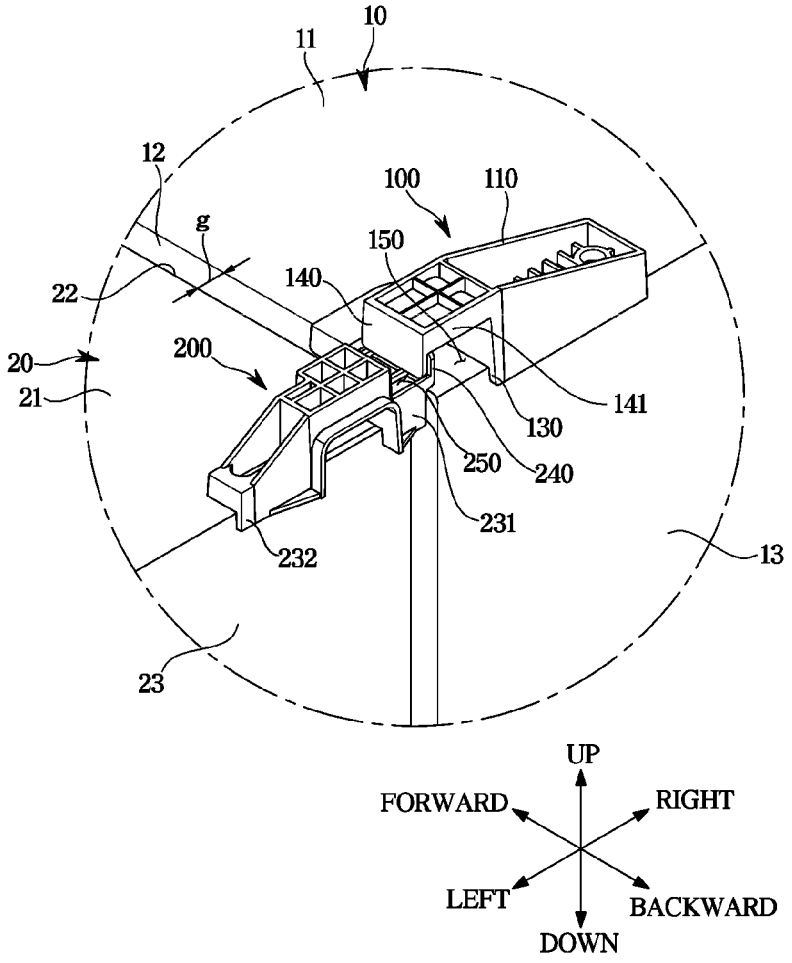
FIG. 3 shows a first bracket and a second bracket shown in FIG. 2, at another angle.

FIG. 2 is an enlarged view showing an area A of FIG. 1. FIG. 3 shows a first bracket and a second bracket shown in FIG. 2, at another angle.

Referring to FIGS. 2 and 3, the first bracket 100 may be coupled to the second bracket 200. After the first bracket 100 is coupled to the second bracket 200, the first bracket 100 and the second bracket 200 may allow movement in first and second directions with respect to each other, and restrict movement in a third direction that is perpendicular to the first and second directions. Hereinafter, the first direction may be a forward direction with reference to the front of the refrigerator, the second direction may be a backward direction with reference to the back of the refrigerator, and the third direction may be a left or right direction with reference to the sides of the refrigerator.

After the first bracket 100 is coupled to the second bracket 200, movement of the first bracket 100 in a left-right direction with respect to the second bracket 200 may be restricted. More specifically, the first bracket 100 may be prevented from moving away from the second bracket 200 in the left-right direction. The reason may be because of a first interfering protrusion 140 is in contact with a second interfering protrusion 240 and caught and restricted by the second interfering protrusion 240. Likewise, after the first bracket 100 is coupled to the second bracket 200, a movement of the second bracket 200 in the left-right direction with respect to the first bracket 100 may also be restricted.

As described above, after the first bracket 100 is coupled to the second bracket 200, movement in the left-right direction may be restricted, and accordingly, movement of the first cabinet 10 and the second cabinet 20 with respect to each other may be restricted. Because the first bracket 100 is fixed to the first cabinet 10 and the second bracket 200 is fixed to the second cabinet 20, movement of the first cabinet 10 and the second cabinet 20 may be restricted with respect to each other due to the restriction of the first bracket 100 and the second bracket 200. At this time, a movement in left-right direction of the first cabinet 10 and the second cabinet 20 may be restricted, and a movement in front-rear direction of the first cabinet 10 and the second cabinet 20 may be not restricted.

After the first bracket 100 is coupled to the second bracket 200, a movement of the first bracket 100 in the forward and backward directions with respect to the second bracket 200 may be not restricted. In other words, a movement of the first bracket 100 in a front-rear direction with respect to the second bracket 200 may be allowed. The first interfering protrusion 140 and the second interfering protrusion 240 may be in contact with each other upon movement in the left-right direction, and may not interfere with each other upon a movement in the front-rear direction.

Likewise, upon coupling of the first bracket 100 and the second bracket 200, a movement of the second bracket 200 in the front-rear direction with respect to the first bracket 100 may be not restricted.

Figure 4:
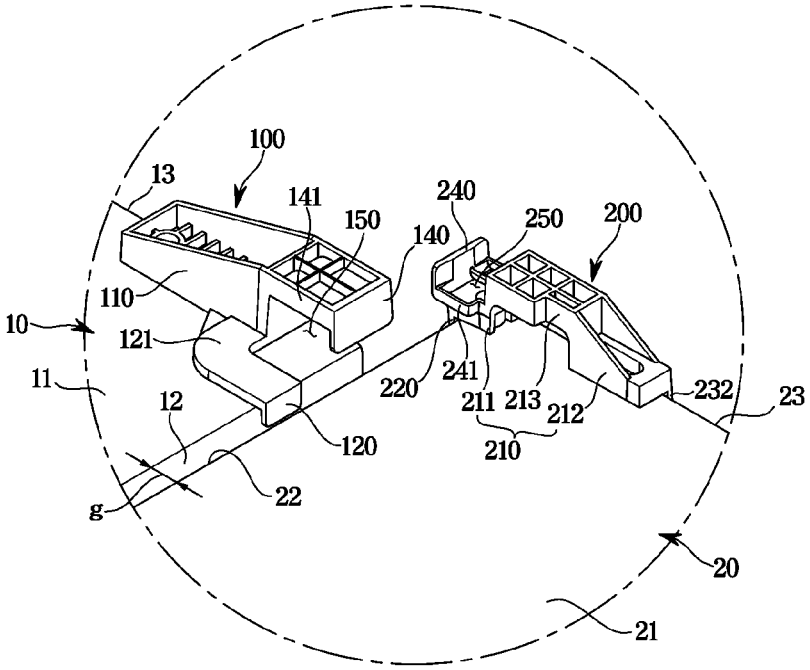
FIG. 4 shows a state in which the first bracket has moved in a forward direction from a position of the first bracket in FIG. 2.
Figure 5:
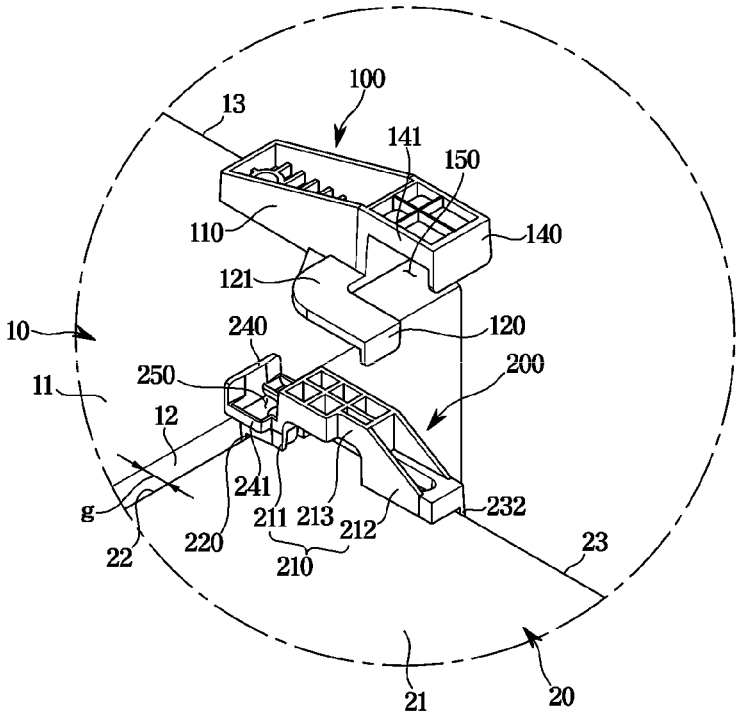
FIG. 5 shows a state in which the second bracket has moved in the forward direction from a position of the second bracket in FIG. 2.

FIG. 4 shows a state in which the first bracket 100 has moved in a forward direction from a position of the first bracket in FIG. 2. FIG. 5 shows a state in which the second bracket 200 has moved in the forward direction from a position of the second bracket in FIG. 2.

Referring to FIG. 4, in a state in which the first bracket 100 and the second bracket 200 are coupled to each other, the first bracket 100 may move in the forward direction with respect to the second bracket 200. That is, a movement of the first bracket 100 in the forward direction with respect to the second bracket 200 may not be restricted.

Referring to FIG. 5, in a state in which the first bracket 100 and the second bracket 200 are coupled to each other, the second bracket 200 may move in the forward direction with respect to the first bracket 100. That is, a movement of the second bracket 200 in the forward direction with respect to the first bracket 100 may not be restricted.

Typically, upon structurally coupling or separating a pair of home appliances, a separate structure and process such as screw coupling or decoupling has been required. For example, to connect a rear side of a first home appliance to a rear side of a second home appliance, one side of a bracket has typically been coupled to a rear surface of the first home appliance, and the other side of the bracket has been coupled to a rear surface of the second home appliance. As a result, the bracket and the rear surface of the first home appliance and the bracket and the rear surface of the second home appliance have been coupled to each other through coupling members such as screws.

Due to the above-described structure, to move any one of the first home appliance and the second home appliance which are structurally coupled to each other in a forward direction, a task of accessing the rear sides of the first home appliance and the second home appliance and separating the coupling members from the first and second home appliances has been required. Generally, because a pair of home appliances are structurally coupled to each other and then positioned in a location in which a rear side is closed, accessibility to the pair of home appliances from the rear direction may be greatly reduced. Therefore, a task of taking both the first home appliance and the second home appliance out in the forward direction, and then separating the coupling members from the first and second home appliances, and replacing/repairing the first home appliance or the second home appliance, has been required.

According to an embodiment of the disclosure, a process of coupling/separating, upon coupling and separating of the first refrigerator 1 as the first home appliance with and from the second refrigerator 2 as the second home appliance, a separate coupling member with/from the first refrigerator 1 and the second refrigerator 2 may be omitted. Although a coupling member needs to be coupled to install the first bracket 100 on the first cabinet 10 and the second bracket 200 on the second bracket 20, no coupling member may be required to couple and separate the first bracket 100 with and from the second bracket 200, which will be described below. That is, the second refrigerator 2 may be positioned beside the first refrigerator 1 or the first refrigerator 1 may be positioned beside the second refrigerator 2 without the need to couple the rear side of the first refrigerator 1 to the rear side of the second refrigerator 2. Thereby, time and manpower required for arranging and coupling the first home appliance and the second home appliance side by side may be reduced, and also, time and manpower required for moving any one of the first home appliance and the second home appliance which are coupled to each other, in the forward direction may be greatly reduced.

Figure 6:
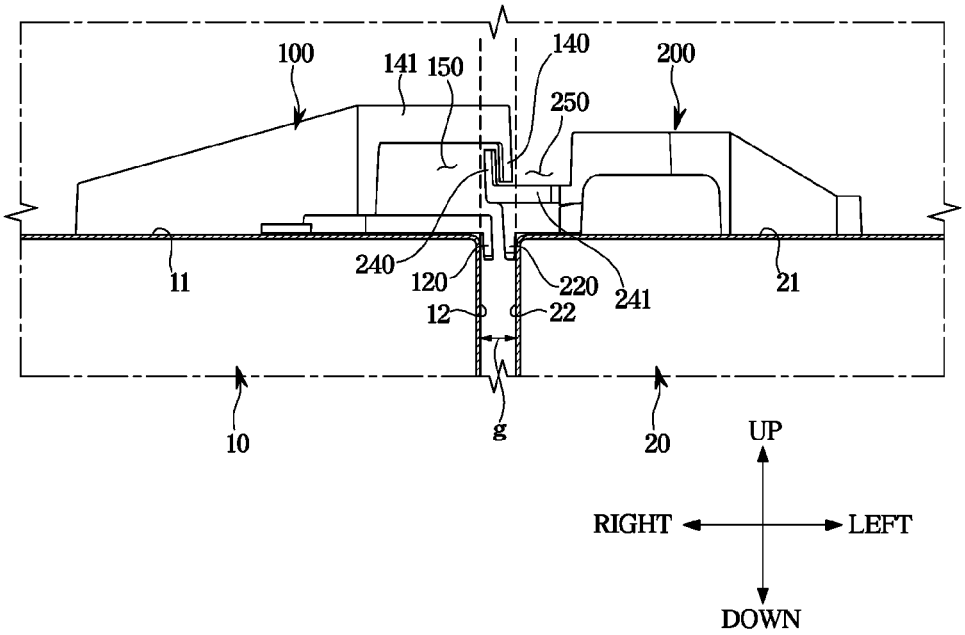
FIG. 6 is a front view of the first bracket and the second bracket shown in FIG. 2.
Figure 7:
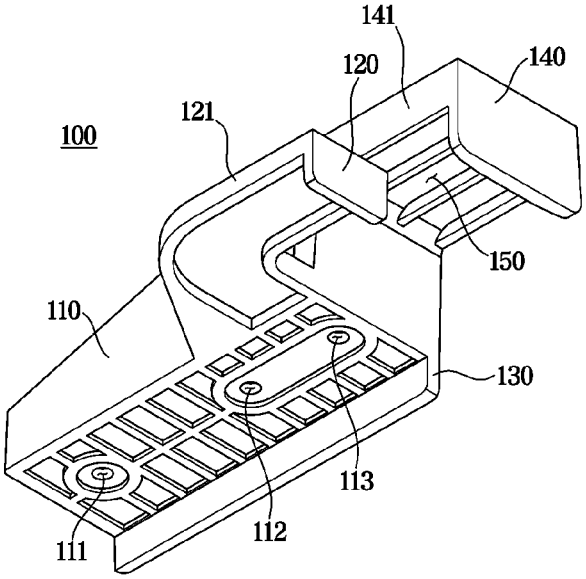
FIG. 7 is a bottom perspective view of the first bracket shown in FIG. 2.
Figure 8:
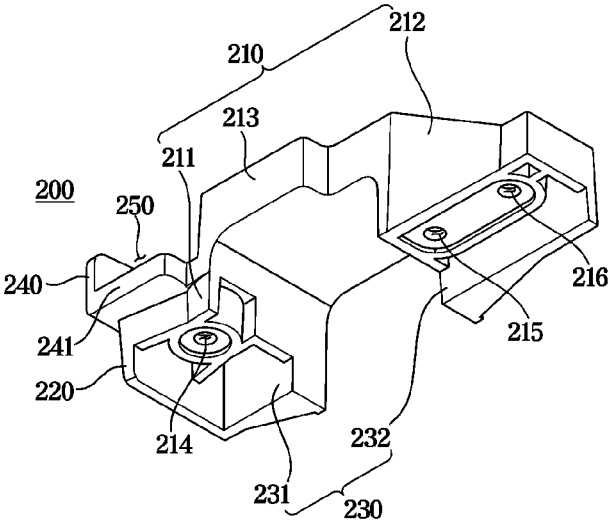
FIG. 8 is a bottom perspective view of the second bracket shown in FIG. 2.

FIG. 6 is a front view of the first bracket and the second bracket shown in FIG. 2. FIG. 7 is a bottom perspective view of the first bracket shown in FIG. 2. FIG. 8 is a bottom perspective view of the second bracket shown in FIG. 2.

Hereinafter, structures of the first bracket 100 and the second bracket 200 according to an embodiment of the disclosure will be described in detail with reference to FIGS. 6 to 8.

Referring to FIG. 7, the first bracket 100 may include a first body 110 coupled to an upper surface 11 (see FIG. 3) of the first cabinet 10, a first guide rib 130 and a second guide rib 120 guiding a coupling location of the first body 110 with respect to the first cabinet 10, and the first interfering protrusion 140. Also, the first bracket 100 may include a first connecting portion 141 connecting the first interfering protrusion 140 to the first body 110, and a first groove 150 formed by the first interfering protrusion 140, the first connecting portion 141, and the first body 110.

The first body 110 may be coupled to the upper surface 11 of the first cabinet 10. The first body 110 may include first to third coupling holes 111, 112, and 113 penetrating the first body 110 in an up-down direction. Coupling members such as screws may be coupled to the first to third coupling holes 111, 112, and 113. More specifically, the coupling members (not shown) may penetrate the first to third coupling holes 111, 112, and 113 and be coupled to the upper surface 11 of the first cabinet 10. By coupling the coupling members with the first to third coupling holes 111, 112, and 113 to be coupled to the upper surface 11 of the first cabinet 10, the first bracket 100 may be coupled to or installed on the first cabinet 10.

According to an embodiment of the disclosure, no separate coupling hole may be provided in the upper surface of the first cabinet 10. After the first bracket 100 is positioned at a preset coupling location by using the first guide rib 130 and the second guide rib 120, the coupling members may penetrate the first to third coupling holes 111, 112, and 113 and be coupled to the first cabinet 10, and thereby, the first bracket 100 may be installed on the first cabinet 10, which will be described below.

The first bracket 100 may include the first guide rib 130 and the second guide rib 120.

The first guide rib 130 may restrict a movement of the first bracket 100 in the front-rear direction with respect to the first cabinet 10. The first guide rib 130 may extend downward to be in contact with a rear surface 13 (see FIG. 3) of the first cabinet 10. Because the first guide rib 130 is in contact with the rear surface 13 of the first cabinet 10, a coupling location in front-rear direction of the first bracket 100 may be decided.

According to an embodiment of the disclosure, the first guide rib 130 may extend downward from one side of the first body 110.

The second guide rib 120 may restrict a movement range of the first bracket 100 in the left-right direction with respect to the first cabinet 10. The second guide rib 120 may extend downward to be in contact with a side surface 12 (see FIG. 3) of the first cabinet 10. Because the second guide rib 120 is in contact with the side surface 12 of the first cabinet 10, a coupling location in left-right direction of the first bracket 100 may be decided.

According to an embodiment of the disclosure, the second guide rib 120 may extend downward from one end of a rib connecting portion 121 extending and bent from the other side of the first body 110.

By the first guide rib 130 and the second guide rib 120 being respectively in contact with the rear surface 13 and the side surface 12 of the first cabinet 10, the first bracket 100 may be positioned at a coupling location. After the first bracket 100 is positioned at the coupling location, the first bracket 100 may be installed on the first cabinet 10 by using the coupling members, as described above.

The first bracket 100 may include the first interfering protrusion 140. The first interfering protrusion 140 may be formed at an end of the first connecting portion 141 extending from the first body 110. The first interfering protrusion 140 and the second guide rib 120 may form two surfaces being parallel to each other. The first interfering protrusion 140, the first connecting portion 141, and the first body 110 may form the first groove 150. Upon installing of the first bracket 100 on the first cabinet 10, the first groove 150 may open in the front-rear direction. Upon installing the first bracket 100 on the first cabinet 10, the first body 110 and the first interfering protrusion 140 may be arranged in the left-right direction by the first groove 150. The second interfering protrusion 240 which will be described below may be inserted into the first groove 150.

According to an embodiment of the disclosure, a lower side of the first groove 150 may open. In other words, a portion of a lower surface of the first connecting portion 141 may be depressed upward to form the first groove 150 and the first interfering protrusion 140.

Referring to FIG. 8, the second bracket 200 may include a second body 210 coupled to an upper surface 21 (see FIG. 3) of the second cabinet 20, a third guide rib 230 and a fourth guide rib 220 guiding a coupling location of the second body 210 with respect to the second cabinet 20, and the second interfering protrusion 240. Also, the second bracket 200 may include a second connecting portion 241 connecting the second interfering protrusion 240 to the second body 210, and a second groove 250 formed by the second interfering protrusion 240, the second connecting portion 241, and the second body 210.

The second body 210 may be coupled to or installed on the upper surface 21 of the second cabinet 20.

According to an embodiment of the disclosure, the second body 210 may include a first body portion 211 including a first coupling hole 214, a second body portion 212 including a fifth coupling hole 215 and a sixth coupling hole 216, and a third body portion 213 connecting the first body portion 211 to the second body portion 212. The first body portion 211 and the second body portion 212 may be in contact with the upper surface 21 of the second cabinet 20, and the third body portion 213 may be spaced from the upper surface 21 of the second cabinet 20.

Coupling members such as screws may be coupled to the fourth to sixth coupling holes 214, 215, and 216. More specifically, the coupling members (not shown) may penetrate the fourth to sixth coupling holes 214, 215, and 216 and be coupled to the upper surface 21 of the second cabinet 20. Because the coupling members penetrate the fourth to sixth coupling holes 214, 215, and 216 to be coupled to the upper surface 21 of the second cabinet 20, the second bracket 200 may be installed on the second cabinet 20.

According to an embodiment of the disclosure, no coupling hole may be provided in the upper surface 21 of the second cabinet 20. By locating the second bracket 200 at a preset coupling location by using the third guide rib 230 and the fourth guide rib 220, then passing the coupling members through the fourth to sixth coupling holes 214, 215, and 216, and coupling the coupling members with the second cabinet 20, the second bracket 200 may be installed on the second cabinet 20, which will be described below.

The second bracket 200 may include a third guide rib 230 and a fourth guide rib 220.

The third guide rib 230 may limit a movement range of the second bracket 200 in the front-rear direction with respect to the second cabinet 20. The third guide rib 230 may extend downward to be in contact with the rear surface 23 (see FIG. 3) of the second cabinet 20. Because the third guide rib 230 is in contact with the rear surface 23 of the second cabinet 20, a coupling location in front-rear direction of the second bracket 200 may be decided.

According to an embodiment of the disclosure, the third guide rib 230 may include a first portion 231 extending downward from one side of the first body portion 211, and a second portion 232 extending downward from one side of the second body portion 212.

The fourth guide rib 220 may limit a movement range of the second bracket 200 in the left-right direction with respect to the second cabinet 20. The fourth guide rib 220 may extend downward to be in contact with a side surface 22 (see FIG. 3) of the second cabinet 20. Because the fourth guide rib 220 is in contact with the side surface 22 of the second cabinet 20, a coupling location in left-right direction of the second bracket 200 may be decided.

According to an embodiment of the disclosure, the fourth guide rib 220 may extend downward from one side of the first body portion 211. The fourth guide rib 220 may be connected to the first portion 231 of the third guide rib 230.

By the third guide rib 230 and the fourth guide rib 220 being respectively in contact with the rear surface 23 and the side surface 22 of the second cabinet 20, the second bracket 200 may be positioned at a coupling location. After the second bracket 200 is positioned at the coupling location, the second bracket 200 may be installed on the second cabinet 20 by using the coupling members, as described above.

The second bracket 200 may include the second interfering protrusion 240. The second interfering protrusion 240 may be formed at an end of the second connecting portion 241 extending from the second body 210. The second interfering protrusion 240 and the fourth guide rib 220 may form two surfaces being parallel to each other. The second interfering protrusion 240, the second connecting portion 241, and the second body 210 may form the second groove 250. Upon installing of the second bracket 200 on the second cabinet 20, the second groove 150 may open in the front-rear direction. Upon installing of the second bracket 200 on the second cabinet 20, the second body 210 and the second interfering protrusion 240 may be arranged in the left-right direction by the second groove 250. The first interfering protrusion 140 may be inserted into the second groove 250.

According to an embodiment of the disclosure, an upper side of the second groove 250 may open. In other words, a portion of an upper surface of the second connecting portion 241 may be depressed downward to form the second groove 250 and the second interfering protrusion 240.

Referring to FIG. 6, the first bracket 100 and the second bracket 200 according to an embodiment of the disclosure may be positioned such that the first interfering protrusion 140 and the second interfering protrusion 240 are positioned between the side surface 22 of the first cabinet 10 and the side surface 22 of the second cabinet 20. More specifically, upon interference of the first interfering protrusion 140 and the second interfering protrusion 240, the first interfering protrusion 140 and the second interfering protrusion 240 may be positioned between the side surface 12 of the first cabinet 10 and the side surface 22 of the second cabinet 20 (between dotted lines of FIG. 6), which face each other.

According to the structure, upon moving or taking-out of the first bracket 100 and the first cabinet 10 in the forward direction from the second bracket 200 and the second cabinet 20, the first interfering protrusion 140 and the first connecting portion 141 of the first bracket 100 may not interfere with a structure located on the upper surface 21 of the second cabinet 20.

Likewise, upon moving or taking-out of the second bracket 200 and the second cabinet 20 in the forward direction from the first bracket 100 and the first cabinet 10, the second interfering protrusion 240 and the second connecting portion 241 of the second bracket 200 may not interfere with a structure located on the upper surface 11 of the first cabinet 10.

Figure 9:
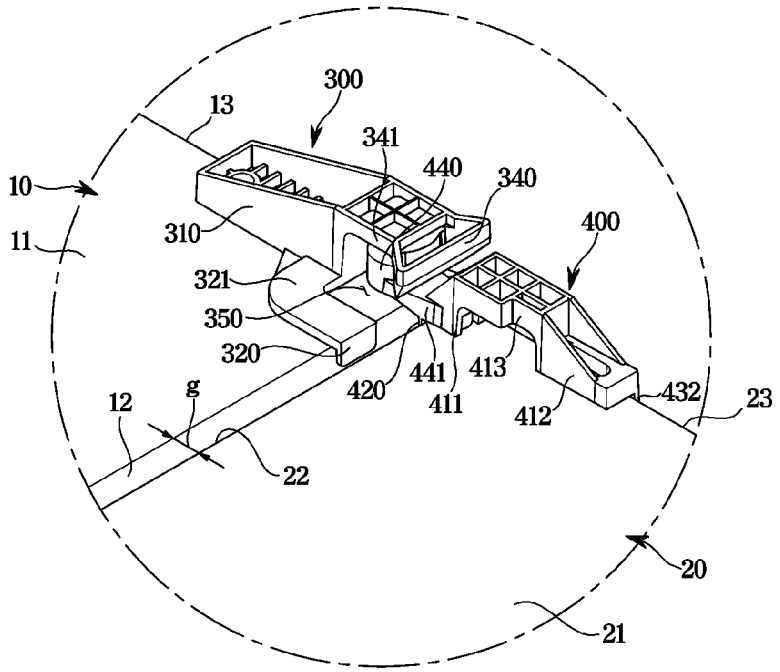
FIG. 9 shows a first bracket and a second bracket in a refrigerator and a home appliance according to another embodiment of the disclosure.
Figure 10:
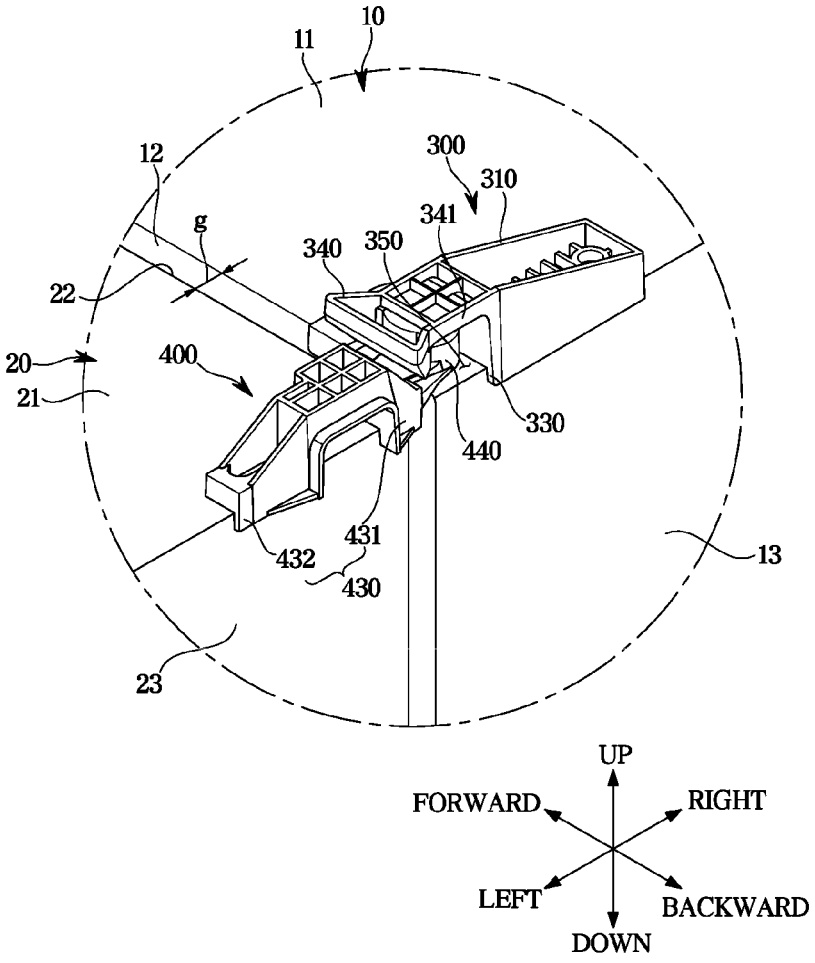
FIG. 10 shows the first bracket and the second bracket shown in FIG. 9, at another angle.
Figure 11:
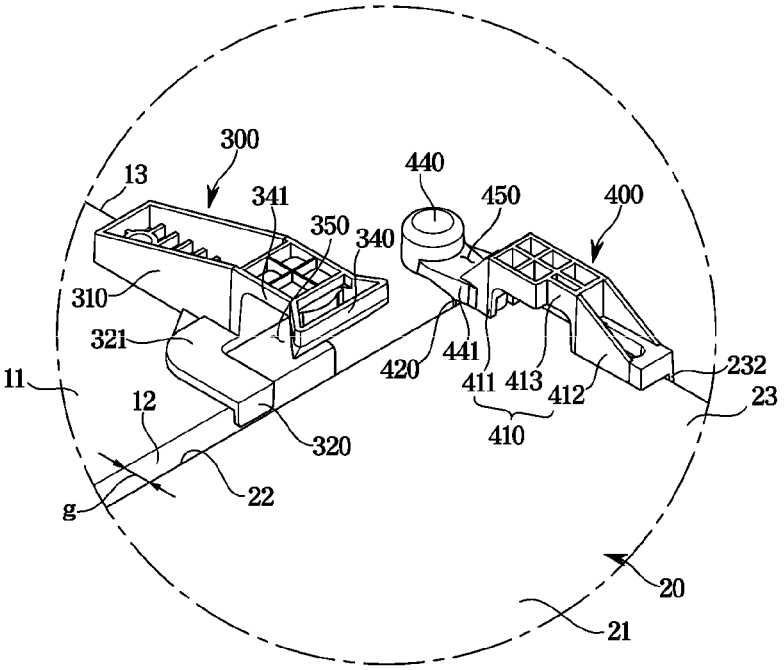
FIG. 11 shows a state in which the first bracket has moved in a forward direction from a position of the first bracket in FIG. 9.
Figure 12:
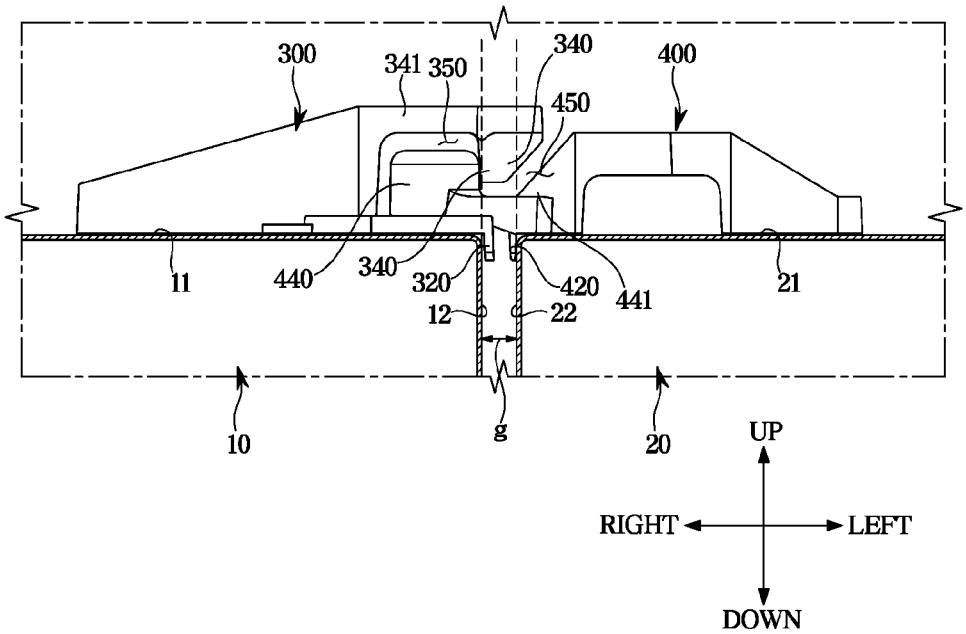
FIG. 12 is a front view of the first bracket and the second bracket shown in FIG. 9.

FIG. 9 shows a first bracket and a second bracket in a refrigerator and a home appliance according to another embodiment of the disclosure. FIG. 10 shows the first bracket and the second bracket shown in FIG. 9, at another angle. FIG. 11 shows a state in which the first bracket has moved in a forward direction from a position of the first bracket in FIG. 9. FIG. 12 is a front view of the first bracket and the second bracket shown in FIG. 9.

Hereinafter, a first bracket 300 and a second bracket 400 according to another embodiment of the disclosure will be described with reference to FIGS. 9 to 12.

Descriptions about the same structures as the first bracket 100 and the second bracket 200 will be omitted.

According to another embodiment of the disclosure, the first bracket 300 may include a first body 310, a first guide rib 330, a second guide rib 320, a rib connecting portion 321, and a first connecting portion 341, which are respectively the same as the first body 110, the first guide rib 130, the second guide rib 120, the rib connecting portion 121, and the first connecting portion 141 of the first bracket 100, as shown in FIGS. 1 to 8.

According to another embodiment of the disclosure, the second bracket 400 may include a second body 420, a third guide rib 430, a fourth guide rib 420, and a second connecting portion 441, which are respectively the same as the second body 210, the third guide rib 230, the fourth guide rib 220, and the second connecting portion 241 of the second bracket 200, as shown in FIGS. 1 to 8.

According to another embodiment of the disclosure, the first bracket 300 may include a first interfering protrusion 340. Upon interference of the first interfering protrusion 340 with a second interfering protrusion 440, at least one portion (a portion protruding to a right side from a right dotted line of FIG. 12) of the first interfering protrusion 340 may be positioned above the upper surface 21 of the second cabinet 20.

According to another embodiment of the disclosure, the second bracket 400 may include the second interfering portion 440 being in a shape of a cylinder. Upon interference of the second interfering portion 440 with the first interfering portion 340, at least one portion (a portion protruding to a left side from a left dotted line of FIG. 12) of the second interfering portion 440 may be positioned above the upper surface 11 of the first cabinet 10.

According to another embodiment of the disclosure, the second interfering portion 440 may be in a shape of a cylinder, and the first interfering portion 340 may include a depressed portion (not shown) depressed in a shape of an arc to correspond to the second interfering protrusion 440. At least one portion of the second interfering protrusion 440 may be inserted in the depressed portion. According to the structure, the first interfering protrusion 340 may be more stably coupled to the second interfering protrusion 440. Accordingly, upon a movement of the first cabinet 10 in the right direction, the second cabinet 20 may stably move in the right direction together with the first cabinet 10. Likewise, upon a movement of the second cabinet 20 in the left direction, the first cabinet 10 may stably move in the left direction together with the second cabinet 20.

Meanwhile, according to an aspect of the disclosure, the first bracket 100 or 300 may be coupled to one side of a rear end of the first cabinet 10, and the second bracket 200 or 400 may be coupled to the other side of a rear end of the second cabinet 20. By coupling the first bracket 100 or 300 with the second bracket 200 or 400, the first bracket 100 or 300 and the second bracket 200 or 400 may restrict a movement in left-right direction of the first cabinet 10 and the second cabinet 20 such that the first cabinet 10 is not spaced away from the second cabinet 20 in the left-right direction. Meanwhile, the first bracket 100 or 300 and the second bracket 200 or 400 may not restrict a movement in front-rear direction of the first cabinet 10 and the second cabinet 20 although the first bracket 100 or 300 is coupled to the second bracket 200 or 400. The first bracket 100 or 300 and the second bracket 200 or 400 may maintain a gap between the rear side of the first cabinet 10 and the rear side of the second cabinet 20 in the left-right direction.

To couple a front side of the first cabinet 10 with a front side of the second cabinet 20, a separate bracket that is different from the first bracket 100 or 300 and the second bracket 200 or 400 may be provided. Also, to couple a front surface of the first cabinet 10 with a front surface of the second cabinet 20, a separate bracket may be provided. Because the brackets are easily accessed from the front direction of the first cabinet 10 and the second cabinet 20, a lot of time and manpower may be not required to couple/separate the brackets with/from the first cabinet 10 and the second cabinet 20 through coupling members.

According to an aspect of the disclosure, there are provided a refrigerator and a home appliance including a bracket for maintaining a gap between a pair of refrigerators arranged side by side and between a pair of home appliances arranged side by side.

According to an aspect of the disclosure, there are provided a refrigerator and a home appliance, which enable a user to take any one of a pair of refrigerators connected to each other and a pair of home appliances connected to each other out in a forward direction without having to access the corresponding refrigerator or home appliance from a rear direction.

According to an aspect of the disclosure, there are provided a refrigerator and a home appliance including a bracket for allowing forward and backward movements of any one of a pair of refrigerators connected to each other and a pair of home appliances connected to each other with respect to the other one and restricting lateral movements of the corresponding refrigerator and home appliance with respect to the other one.

According to an aspect of the disclosure, there are provided a refrigerator and a home appliance including a bracket for coupling/separating rear ends of a pair of refrigerators and a pair of home appliances with/from each other without a separate coupling member.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A refrigerator comprising:

a first refrigerator including a first cabinet;

a second refrigerator including a second cabinet, and configured to operate independently from the first refrigerator;

a first connector coupled to the first cabinet; and a second connector coupled to the second cabinet and configured to be coupled to the first connector, a movement of the first cabinet in a first direction and a second direction with respect to the second cabinet and a movement of the second cabinet in the first direction and the second direction with respect to the first cabinet, being-allowed based on the first and second connectors being coupled to each other, the second direction being opposite to the first direction, such that the movement of the first and second cabinets in the first and second directions with respect to one another being allowed, while the first and second connectors are coupled and while the first and second connectors are decoupled, and a movement of the first cabinet in a third direction with respect to the second cabinet and a movement of the second cabinet in the third direction with respect to the first cabinet, being-restricted based on the first and second connectors being coupled to each other, the third direction being perpendicular to the first direction and the second direction.

2. The refrigerator of claim 1, wherein, with reference to the first and second refrigerators, the first direction is a forward direction, the second direction is a backward direction, and the third direction is a left direction or a right direction.

3. The refrigerator of claim 1, wherein the first connector is coupled to the second connector to maintain a gap between the first cabinet and the second cabinet in a left-right direction.

4. The refrigerator of claim 1, wherein the first connector is coupled to an upper surface of the first cabinet, and the second connector is coupled to an upper surface of the second cabinet.

5. The refrigerator of claim 1, wherein the first connector is coupled to one side of a rear end of the first cabinet, and the second connector is coupled to the other side of a rear end of the second cabinet to correspond to the first connector.

6. The refrigerator of claim 1, wherein, in a state in which the first connector is coupled to the second connector, the first connector is separated from the second connector by moving the first cabinet in the first direction or the second direction with respect to the second cabinet, and the second connector is separated from the first connector by moving the second cabinet in the first direction or the second direction with respect to the first cabinet.

7. The refrigerator of claim 1, wherein, in a separated state of the first connector and the second connector, the first connector is coupled to the second connector by moving the first cabinet in the first direction or the second direction with respect to the second cabinet, and the second connector is coupled to the first connector by moving the second cabinet in the first direction or the second direction with respect to the first cabinet.

8. The refrigerator of claim 1, wherein the first connector comprises a first bracket including a first guide rib and a second guide rib guiding a coupling position of the first bracket with respect to the first cabinet, the first guide rib limits a movement range of the first bracket in the first direction with respect to the first cabinet by contacting a rear surface of the first cabinet, and the second guide rib limits a movement range of the first bracket in the third direction with respect to the first cabinet by contacting a side surface of the first cabinet.

9. The refrigerator of claim 8, wherein the second connector comprises a second bracket including a third guide rib and a fourth guide rib guiding a coupling position of the second bracket with respect to the second cabinet, the third guide rib limits a movement range of the second bracket in the first direction with respect to the second cabinet by contacting a rear surface of the second cabinet, and the fourth guide rib limits a movement range of the second bracket in a fourth direction with respect to the second cabinet by contacting a side surface of the second cabinet, the side surface of the second side cabinet facing the side surface of the first cabinet, the fourth direction being opposite to the third direction.

10. The refrigerator of claim 1, wherein the first connector comprises a first bracket including a first interfering protrusion, and the second connector comprises a second bracket including a second interfering protrusion restricting a movement of the second bracket in the third direction by being caught by the first interfering protrusion, based on movement of the second bracket in the third direction with respect to the first bracket.

11. The refrigerator of claim 10, wherein the first interfering protrusion and the second interfering protrusion do not interfere with each other based on movement of the first bracket or the second bracket in the first direction or the second direction with respect to the second bracket or the first bracket.

12. The refrigerator of claim 10, wherein the first bracket includes a first groove in which the second interfering protrusion is inserted, the second bracket includes a second groove in which the first interfering protrusion is inserted, and the first interfering protrusion is inserted into the second groove, and the second interfering protrusion is inserted into the first groove.

13. The refrigerator of claim 12, wherein, based on the first interfering protrusion being inserted in the second groove, movement of the first bracket in the third direction with respect to the second bracket, is restricted, and based on the first bracket being moved in the first direction or the second direction with respect to the second bracket and the first interfering protrusion being taken out of the second groove, movement of the first bracket in the third direction with respect to the second bracket, is allowed.

14. The refrigerator of claim 12, wherein, based on the second interfering protrusion being inserted in the first groove, movement of the second bracket in the third direction with respect to the first bracket, is restricted, and based on the second bracket being moved in the first direction or the second direction with respect to the first bracket to take the second interfering protrusion out of the first groove, movement of the second bracket in the third direction with respect to the first bracket, is allowed.

15. The refrigerator of claim 10, wherein, in a state in which the first interfering protrusion and the second interfering protrusion interfere, the first interfering protrusion and the second interfering protrusion are positioned between a side surface of the first cabinet and a side surface of the second cabinet that face each other.

16. An appliance comprising:

a first appliance including a first cabinet;

a second appliance including a second cabinet;

a first connector extending from the first cabinet; and a second connector extending from the second cabinet and configured to be coupled to the first connector, the first and second connectors being configured to allow movement of the first and second cabinets in a first direction and a second direction based on the first and second connectors being coupled to each other, the second direction being opposite to the first direction, such that the movement of the first and second cabinets in the first and second directions with respect to one another being allowed, while the first and second connectors are coupled and while the first and second connectors are decoupled; and the first and second connectors being configured to restrict movement of the first and second cabinets in a third direction and a fourth direction based on the first and second connectors being coupled to each other, the third direction and the fourth direction being opposite to each other, and the third direction being perpendicular to the first direction and the second direction.

* * * * *